US008965004B2

(12) United States Patent
Scopece et al.

(10) Patent No.: US 8,965,004 B2
(45) Date of Patent: Feb. 24, 2015

(54) METHOD FOR ACQUIRING AUDIO SIGNALS, AND AUDIO ACQUISITION SYSTEM THEREOF

(75) Inventors: Leonardo Scopece, Beinasco (IT); Angelo Farina, Parma (IT)

(73) Assignees: RAI Radiotelevisione Italiana S.p.A., Rome (IT); Aida S.R.L, Parma (IT)

( * ) Notice: Subject to any disclaimer, the term of this patent is extended or adjusted under 35 U.S.C. 154(b) by 431 days.

(21) Appl. No.: 13/496,375

(22) PCT Filed: Sep. 17, 2010

(86) PCT No.: PCT/IB2010/054210

§ 371 (c)(1),
(2), (4) Date: Apr. 6, 2012

(87) PCT Pub. No.: WO2011/042823

PCT Pub. Date: Apr. 14, 2011

(65) Prior Publication Data

US 2012/0188434 A1 Jul. 26, 2012

(30) Foreign Application Priority Data

Sep. 18, 2009 (IT) ..... TO2009A0713

(51) Int. Cl.
*H04R 3/00* (2006.01)
*G10L 21/0216* (2013.01)

(52) U.S. Cl.
CPC ..... *H04R 3/005* (2013.01); *G10L 2021/02166* (2013.01); *H04R 2201/401* (2013.01); *H04R 2430/20* (2013.01)
USPC ..... 381/92

(58) Field of Classification Search
CPC ..... H04R 3/005; H04R 1/406; H04R 1/222; H04R 25/407; H04R 2201/401; H04R 2201/403
USPC ..... 381/92, 91
See application file for complete search history.

(56) References Cited

U.S. PATENT DOCUMENTS 6,157,403 A * 12/2000 Nagata ..... 348/171
6,618,485 B1 * 9/2003 Matsuo ..... 381/92

(Continued)

FOREIGN PATENT DOCUMENTS

EP 0869697 A2 10/1998
WO 2007/037700 A1 4/2007

OTHER PUBLICATIONS

Matsumoto, et al. "A Miniaturized Adaptive Microphone Array Under Directional Constraint Utilizing Aggregated Microphones" The Journal of the Acoustical Society of America, American Institute of Physics for the Acoustical Society of America, New York, NY, US, vol. 119 No. 1, Jan. 1, 2006 pp. 352-359.

(Continued)

*Primary Examiner* — Simon Sing
(74) *Attorney, Agent, or Firm* — Workman Nydegger

(57) ABSTRACT

Method for acquiring audio signals is described, wherein a microphone probe (11) equipped with a plurality (Y) of microphone capsules (B) detects a plurality of audio signals, and wherein said detected audio signals are combined together in order to obtain a virtual microphone signal. The latter is generated as a function of characteristic probe data (IRs) measured during a probe characterization step, wherein the signals detected by each microphone capsule (B) are measured following a corresponding predetermined test signal. An audio acquisition system is also described which allows to implement the method.

15 Claims, 8 Drawing Sheets

(56) References Cited

U.S. PATENT DOCUMENTS

| | | | | |
|---|---|---|---|---|
| 6,694,028 | B1 * | 2/2004 | Matsuo | 381/92 |
| 8,121,311 | B2 * | 2/2012 | Hetherington | 381/93 |
| 2008/0013762 | A1 | 1/2008 | Roeck et al. | |

OTHER PUBLICATIONS

Wang A. et al. "Calibration, Optimization, and DSP Implementation of Microphone Array for Speech Processing" IEEE 1996, pp. 225-226.

Martignon, et al. "Multi-Channel Signal Processing for Microphones Arrays", Audio Engineering Society, Convention Paper 6680, Presented at the 120$^{th}$ Convention May 1, 2006.

Hoffman, "Microphone Array Calibration for Robust Adaptive Processing," IEEE, Oct. 1995, pp. 11-14.

Wenzel, et al. "Sound Lab: A Real-Time, Software-Based System for the Study of Spatial Hearing," Internet citation, Feb. 19, 2000, retrieved on Mar. 26, 2007 from URL http://pddocserv/specdocs/data/hand boo/ks/AES/Conv-Preprints/2000/PPOO02/5140.pdf.

Kirkeby, et al., "Digital Filter Design for Inversion Problems in Sound Reproduction," Journal of the Aucio Engineering Society, AES, New York, NY, vol. 47, No. 7/08, Jul. 1, 1999, pp. 583-595.

International Search Report for PCT/IB2010/054210, mailed Dec. 15, 2010.

International Preliminary Report on Patentability dated Mar. 20, 2012 for PCT/IB2010/054210 filed Sep. 17, 2010.

* cited by examiner

METHOD FOR ACQUIRING AUDIO SIGNALS, AND AUDIO ACQUISITION SYSTEM THEREOF

BACKGROUND OF THE INVENTION

1. Field of the Invention

The present invention relates to a method for acquiring audio signals and an audio acquisition system capable of implementing said method.

In the television and movie fields and the like, there is an increasing need to record sounds accurately in the three-dimensional environment in which shooting is taking place, so that they can be reproduced faithfully at the user's premises.

Recording sounds in a three-dimensional environment involves the necessity of knowing the pressure and speed of the air particles in a certain spatial point.

To this end, it is currently known to use microphone probes which comprise multiple microphone capsules arranged on a surface, e.g. a spherical surface.

One example of such probes is the microphone probe available on the market under the name "EigenMike32" and manufactured by the American company "mhAcoustics".

FIG. 1 shows an example of a probe 11 which allows audio signals to be acquired from multiple spatial directions. Said probe 11 comprises a number Y (in this case thirty-two) of microphone capsules B arranged on a rigid and substantially spherical shell C.

Each of the capsules B detects one audio signal coming from a different spatial direction.

By appropriately combining these signals it is possible to obtain a signal corresponding to the signal that would be measured by a microphone having certain desired characteristics.

Thanks to these probes, the user can use "virtual" microphones having the desired characteristics of directivity (cardioid, supercardioid or the like) and position (azimuth, elevation, etc.).

2. Present State of the Art

Probes of this type are generally used in combination with graphic systems in order to display for the user any noise sources and identify any mechanical defects in a machine (e.g. a broken tooth of a toothed wheel) or any sources of noise pollution.

For this purpose, much importance is attributed in the known probes to the microphone directivity, and much effort is being made to define optimal filters which can ensure the best possible directionality.

Once the optimal theoretical filters have been identified, the audio signal of the virtual microphone required by the user is generated by appropriately weighing the filter outputs and by applying thereto delays and gains which are suitably calculated and then combined together in order to obtain certain forms of microphone directivity.

A first limit of these probes is related to the fact that the use of predetermined theoretical filters, although it provides good directivity, often does not ensure a good audio signal quality.

Moreover, another limit of these known probes is the fact that they can only provide good directivity up to certain frequencies, typically around 4 kHz, whereas beyond which the directivity tends to deteriorate.

These probes are therefore not suitable for use in the television or cinematographic environment, wherein, in addition to the microphone directionality, it is also very important to be able to acquire high-quality audio signals.

SUMMARY OF THE INVENTION

It is the object of the present invention to provide a method for acquiring audio signals and a related audio acquisition system which can overcome the drawbacks of the prior art.

This object is achieved through a method and a system incorporating the features set out in the appended claims, which are intended as an integral part of the present description.

The present invention is based on the idea of processing the signals acquired by the capsules of the probe by starting from actual probe data measured empirically during a probe characterization step.

In particular, filters are used which, instead of being calculated theoretically, are determined empirically during a probe characterization step in which the impulse responses of the capsules to one or more predetermined test signals are detected.

Thus, when in operation, the system allows to detect high-quality audio signals because any differences in the performance of the capsules from the nominal specifications will not affect the quality of the detected signal.

Also, it is thus possible to take into account the effect of the probe support, which de facto interrupts the perfect symmetry of the probe.

Furthermore, the probe can maintain good directivity of the virtual microphone even at high frequencies over 4 kHz, in that the signal of the virtual microphone is not based on a theoretical filtering process, but on a filtering process which depends on the actual characteristics of the probe, and in particular on the impulse responses of the capsules, calculated by starting from test signals determined beforehand during a probe characterization step.

BRIEF DESCRIPTION OF THE DRAWINGS

Further objects and advantages of the present invention will become apparent from the following description of an embodiment thereof as shown in the annexed drawings, which are supplied by way of non-limiting example, wherein.

DETAILED DESCRIPTION OF THE PREFERRED EMBODIMENTS

Figure 1:
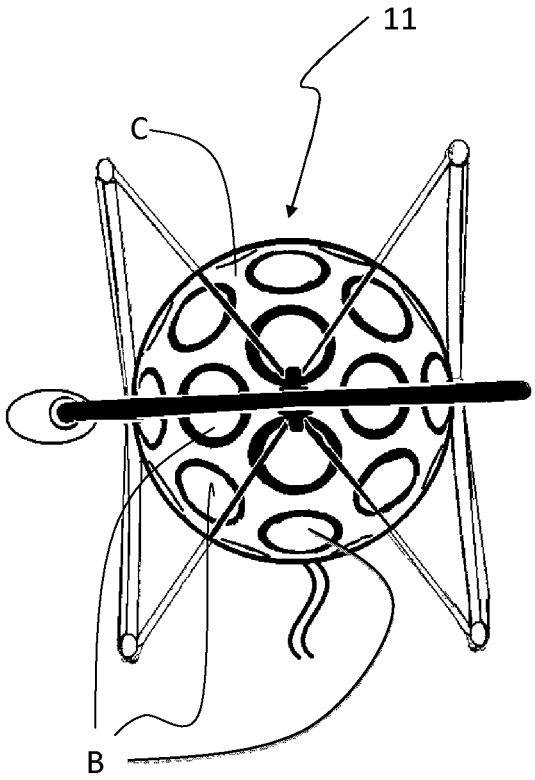
FIG. 1 shows a known microphone probe like the one previously described.
Figure 2:
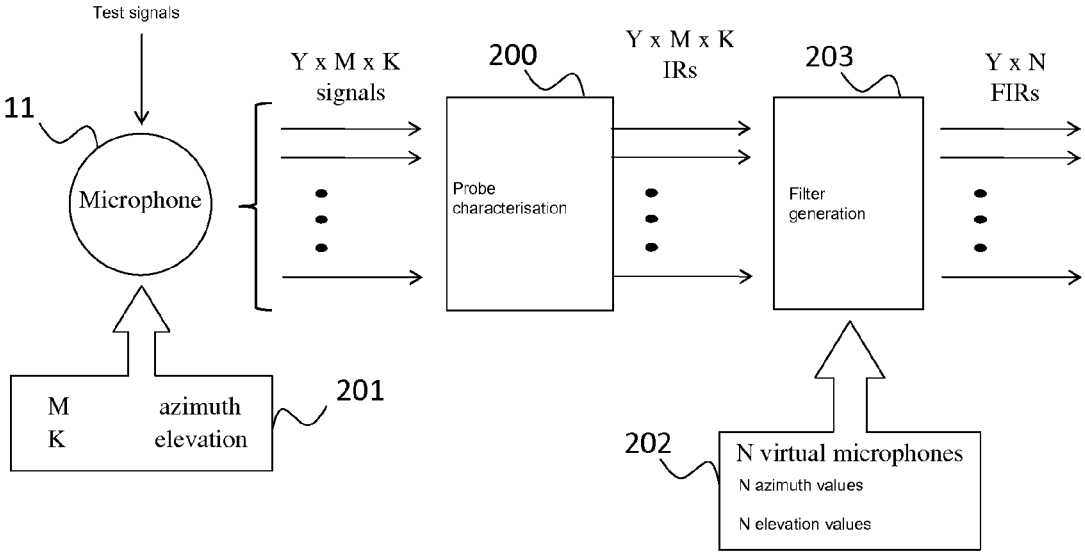
FIG. 2 schematically shows the steps of the method according to the present invention.

Referring now to FIG. 2, the method according to the present invention provides for the preliminary execution of a first step of characterization of the microphone probe 11, called PROBE CHARACTERIZATION in FIG. 2, by generating an IRs (Impulse Responses) matrix derived from a measurement of the responses of a number Y of microphone capsules of a microphone probe (like the probe A described above) when subjected to a test signal (preferably of the impulsive type) in an anechoic chamber, and of a second step (called FILTER GENERATION) of generation of a matrix of FIRs (Finite Impulse Responses) filters on the basis of the IRs (Impulse Responses) matrix and of virtual microphone parameters which can be set by an operator.

In the first step 200 of the method, the microphone probe 11 is placed into an anechoic chamber (or a similar environment) in which one or more test signals are generated, preferably at least one sinusoidal signal whose frequency is changed over substantially the whole audible frequency spectrum, i.e. a so-called "logarithmic sine sweep", from whose convolution with an inverse signal (i.e. "reversed" on the time axis) the probe response to the impulse is obtained: this technique is per se known and therefore it will not be described any further; it must however be pointed out that it can also be found in the main standards defining impulse response measurements (e.g. the ISO 3382 standard).

For each test signal, the impulse responses of each capsule B are recorded by varying in regular steps (action schematized in block 201) azimuth and elevation of the direction from which the test signal is coming; in FIG. 2, azimuth and elevation relative to the coordinate centre (coinciding with the geometric centre of the probe 11) are identified by references M and K.

This provides a set of transfer functions between every single capsule and loudspeaker (which generates the signal) for each direction around the probe centre.

The probe is thus characterized along the three spatial dimensions by a number of transfer functions equal to Y×M×K, where:

Y is the number of microphone capsules of the microphone probe 11,

M is the azimuth of the test signal relative to a spherical coordinate centre originating from the centre of the probe A, K is the elevation of the test signal relative to that coordinate system.

These transfer functions are expressed in matrix form by means of the matrix of the IRs impulse responses, which is stored in a memory area of the audio acquisition system associated with the probe.

A size of the IRs matrix (the number of rows for example) is equal to Y, whereas the other size of the IRs matrix (the number of columns for example) is equal to M×K.

The IRs matrix contains data that characterizes the probe's capsules; since it has been measured empirically, this data is not the nominal data.

The actual characteristics of the probe 11 are thus advantageously detected and it is possible, in operation, to acquire a signal of better quality because it is taken into consideration the fact that each of the Y microphone capsules B may behave differently from the other ones, as well as the fact that the probe is not perfectly spherical, at least due to the presence of a support.

Once this first step of PROBE CHARACTERIZATION has been carried out, and after having consequently defined the IRs matrix, it is possible to use the microphone probe 11 in order to acquire sound, or audio signals, in an environment.

In a three-dimensional environment, the signals received by the Y capsules may come from multiple spatially distributed sources.

In order to choose which source must be listened to and recorded by the probe, it is necessary to synthesize a virtual microphone by starting from the signals detected by the Y microphone capsules.

In other words, the audio signals picked up by the real capsules B of the microphone probe 11 are processed in a manner such as to obtain a signal which ideally corresponds to the one that would be acquired by a microphone whose parameters could be chosen at will by an operator, more specifically pointing direction and directivity.

By "microphone directivity" it is meant the way in which the sensitivity of the microphone varies as the sound incidence angle changes: it may be, for example, cardioid, supercardioid, cardioid of the 3rd order or the like.

The other parameters of a microphone are, more in general, sensitivity, response curve, noise, distortion, dynamic range, impedance, and transient response; in the present text, however, only pointing direction and directivity will be taken into account as parameters of the virtual microphone, leaving out the remaining parameters listed above.

The operator thus chooses the parameters of one or more virtual microphones to be used in the environment where the sound field is to be picked up, e.g. to concentrate on certain areas of the environment to be detected with (virtual) microphones having a certain directivity.

The definition of the parameters of the virtual microphones is schematized in FIG. 2 by block 202.

In accordance with the teachings of the present invention, the virtual microphones are generated in the method step designated in FIG. 2 as "FILTER GENERATION" (reference numeral 203), and involves the generation of a matrix of FIRs filters which is used (as will be explained more in detail hereafter) for filtering the signal picked up by the real microphone capsules B of the probe 11.

As will be better explained below, the operator interacting with the audio acquisition system defines the parameters of the virtual microphone(s) by giving inputs to the system, e.g. by moving a joystick and selecting in real time an area of the environment to be listened to.

Based on the operator inputs, the system generates (step 204 in FIG. 4) a matrix called "target function" A, of size (M×K), which depends on the characteristics of the virtual microphone(s) corresponding to the inputs received from the operator.

The matrix A is thus that matrix which represents the directivity model of the virtual microphone, i.e. that spatial figure which the virtual microphone must tend to.

The elements $a_{i,j}$ generally have a value, preferably between 0 and 1, which depends on the spatial coordinates (azimuth and elevation) and directivity of the desired virtual microphone.

The mathematical expression of directivity (e.g. cardioid, supercardioid, cardioid of the 3rd order, etc.) is per se known and is described by functions known in the literature; therefore, the man skilled in the art can create the matrix A corresponding to the desired microphone(s).

The matrix H of FIRs filters is then generated (step 203 in FIGS. 2 and 4) by using the known Kirkeby algorithm (in "matlab" notation):

$$H = A \cdot \frac{Conj[IRs(\omega)]}{Conj[IRs(\omega)] \cdot IRs(\omega) + \varepsilon(\omega)} \tag{1}$$

that is (in standard notation):

$$H = A \cdot [IRs(\omega)]^{*T} * ([IRs(\omega)]^{*T} \cdot IRs(\omega) + \epsilon(\omega))^{-1} \tag{2}$$

where:

IRs(ω) is the impulse response matrix generated in the previously described characterization step, A is the "target function" generated on the basis of the virtual microphone parameters chosen by the operator, $\epsilon(\omega)$ is a "regularization" parameter to prevent that the filtering process may produce undesired low-frequency and high-frequency artifacts, $\epsilon(\omega)$ is a matrix of size N×N with the diagonal elements equal to a same value $\bar{\epsilon}(\omega)$, where N is the number of virtual microphones, Conj[IRs(ω)] is an operation that outputs the conjugate transpose matrix of the matrix IRs(ω), H is a matrix of size Y×N.

The choice of the value of the regularization parameter $\epsilon$ in the Kirkeby algorithm is preferably made empirically during the probe characterization step, when, while measuring the impulse responses of the capsules, the signals detected by the probe are recorded.

In this step, $\epsilon$ is changed until a high-quality recorded signal is obtained.

The effect of the filtering is in fact to modify, frequency per frequency, the amplitudes of the signals received by the capsules, so that the sum thereof gives at the output the signal of the desired virtual microphone.

In this step, some frequencies of the signals coming from the capsules must be amplified, e.g. in order to fill spectral holes, while other frequencies must be lowered because they would be emphasized too much in the signal of the virtual microphone.

Depending on the chosen $\epsilon$, the filter matrix calculated by means of the Kirkeby algorithm will compensate differently for the frequencies of the signals coming from the capsules Y and, as a result, the quality of the signal of the virtual microphone will change. In particular, at the low or high frequencies it is necessary to use a different regularization parameter from the one used in the central band, so as to limit the inversion produced by Kirkeby's formula and to prevent the calculated filter from becoming unstable and annoying artifacts from being produced during the listening phase.

In particular, in order to obtain a good quality virtual signal, the regularization parameter $\epsilon$ must in substance be chosen in a manner such that it is sufficiently high at high frequencies (in particular over 14 kHz) and at low frequencies (in particular under 100 Hz) while being sufficiently low within a central frequency band, so that the frequency amplification or damping obtained by means of the filtering obtained with the Kirkeby algorithm will be lower at the high and low frequencies and greater in the central frequency range.

The preferred values of $\bar{\epsilon}$ are:

$0.09 \leq \bar{\epsilon} \leq 10$, more preferably $0.1 \leq \bar{\epsilon} \leq 3$, for frequencies higher than 14 kHz or lower than 100 Hz;

$0.001 \leq \bar{\epsilon} \leq 0.089$, more preferably $0.002 \leq \bar{\epsilon} \leq 0.05$, for frequencies between 100 Hz and 14 kHz.

Figure 4:
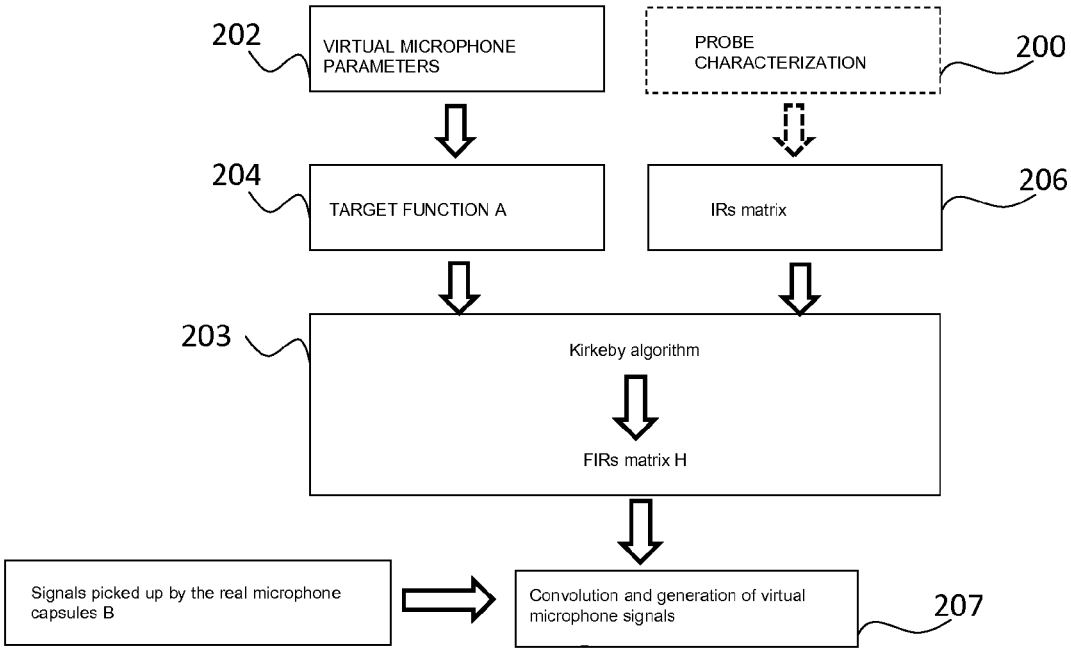
FIG. 4 is a block diagram of a step of the method according to the present invention.

Referring back to the matrix equation (1), it can be observed that the generated filter matrix H is affected both by the operator's choices (which have an impact on the determination of the target function A) and by the actual probe characterization (which influences the determination of the IRs matrix, block 206 in FIG. 4).

This advantageously leads to obtain from the process of filtering the signals received by the real capsules B an extremely natural result of the acoustic field of the environment, which will be faithful to the characteristics of the environment while providing flexibility based on the parameters set by the operator.

Once the matrix H has been thus determined, the virtual microphones are synthesized by filtering the signals picked up by the capsules through the filters determined in accordance with the above-described method.

The signal coming from each capsule is combined (step 207), by means of a convolution operation, with a suitable filter and is then added to the other signals in order to obtain the signal of the desired virtual microphone:

$$\begin{cases} \text{Virtual_Mic_1} = \sum_{i=1}^{Y} FIR_{i,1} \otimes Ch_i \\ \vdots \\ \text{Virtual_Mic_N} = \sum_{i=1}^{Y} FIR_{i,N} \otimes Ch_1 \end{cases}$$

where:

Virtual_Mic__1 . . . N indicates the audio signal detected by each virtual microphone, $FIR_{}_{i,1 \ldots N}$ indicates the element i,1 . . . N of the matrix H, $Ch_i$ indicates the signal picked up by the i-th microphone capsule of the probe.

Figure 3:
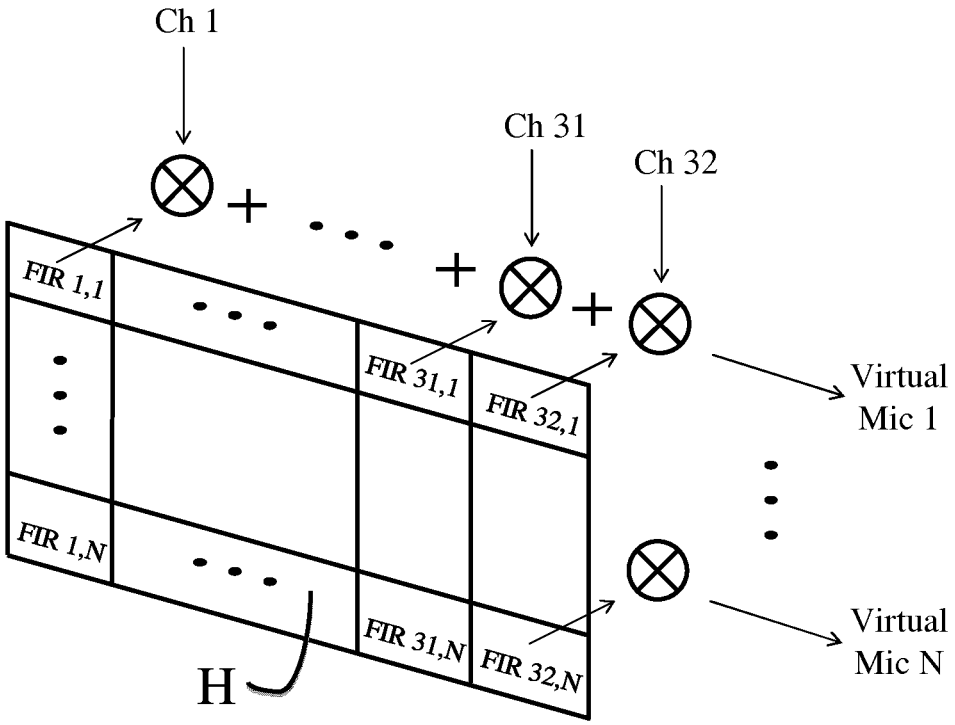
FIG. 3 synthetically illustrates a convolution operation used by the method according to the present invention.

A graphic diagram of said convolution is also shown in FIG. 3, whereas the second step of the method, called FILTER GENERATION, is also shown in the information flow of FIG. 4.

The above-described method advantageously allows the virtual microphone parameters to be changed in real time.

The operator can change the parameters of the virtual microphone in use (e.g. in order to follow an actor in a cinematographic scene or the action taking place in a certain point of the environment) by acting upon a dedicated control console.

Upon receiving an input corresponding to a change in the parameters of one of the virtual microphones or a request to add or eliminate a virtual microphone, the system will recalculate the filter matrix H.

Figure 5:
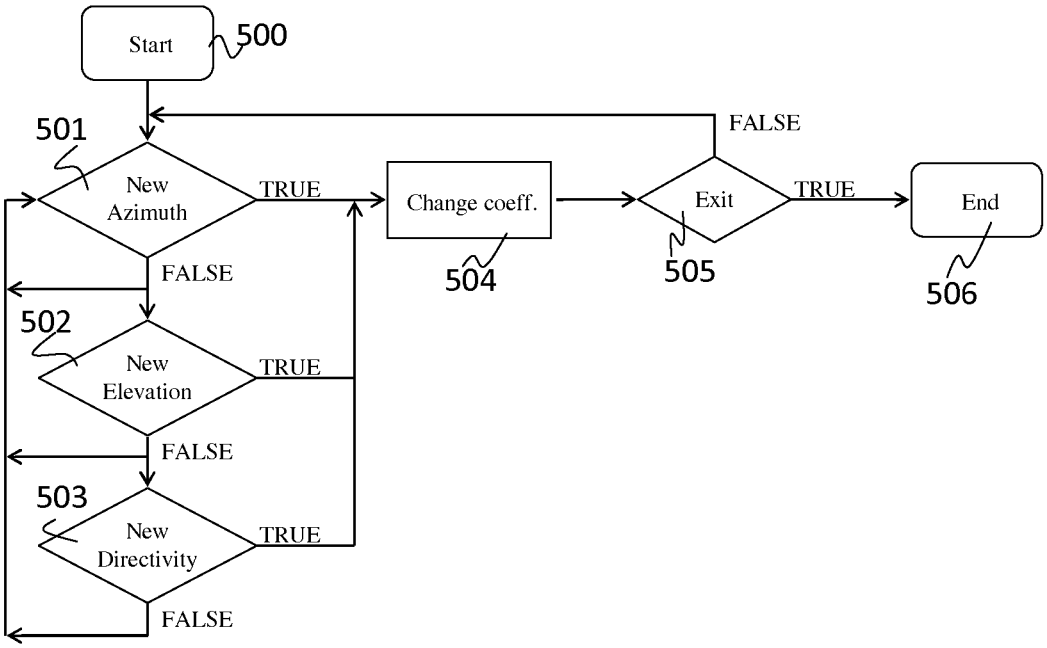
FIG. 5 is a block diagram of a step of the method according to the present invention when the parameters of a virtual microphone are changed.

The flow chart of this operation is shown in FIG. 5.

After turning on a virtual microphone (step 500), it is checked whether an input has arrived which requires a change to the azimuth (step 501); if not, it is checked whether an input has arrived which requires a change in elevation (step 502) and, if also this check gives a negative result, it is checked whether an input has arrived which requires a change in directivity (step 503).

If this last check is also negative, the method goes back to step 501.

Otherwise, if any one of the checks made in the steps 501 to 503 gives a positive result, then the coefficients of the target functions A are recalculated based on the new input (step 504).

After the coefficients have been changed, they can be used by the processor to generate the filter matrix H.

The algorithm schematized in FIG. 5 provides for checking whether the microphone is still active or not (step 505) after the coefficients of the matrix A have been updated. If the microphone is still active, then the process goes back to step 501 and the parameters of the virtual microphone are checked again; if the microphone is not active anymore, then the algorithm is ended (step 506).

In short, therefore, when the operator varies the azimuth and/or elevation and/or directivity of the virtual microphone (and thus the parameters thereof), the coefficients of the target function matrix A are changed accordingly and the matrix H is re-calculated.

According to a further improvement, it is also possible to change a virtual microphone without generating a sensation of "jerky" motion affected by disturbances or ground noise: this can be done by executing a dynamic "crossfade" between the audio coming from the virtual microphone in use and that coming from the virtual microphone to which the operator wants to move.

In substance, when the operator changes the virtual microphone in use and chooses a second one, the switch between a first matrix H corresponding to a first microphone (the microphone in use) and a second matrix H corresponding to a second microphone (the microphone to which the operator wants to move) is carried out gradually by means of an ordered set of transaction matrices (i.e. transaction filters). The sound picked up by the capsules B is filtered with the transaction matrices according to their order. More in detail, the ordered set of transaction matrices $T_1, T_2, T_3 \ldots T_n$ allows to switch between the first matrix and the second matrix as follows: at the beginning the sound is filtered by the first matrix, then it is filtered by transaction matrix $T_1$, then by transaction matrix $T_2$, then by transaction matrix $T_3$ and so on till to arrive at the second matrix.

Each of the transaction matrices $T_1, T_2, T_3 \ldots T_n$ comprises submatrices corresponding to submatrices belonging to either the first matrix or the second matrix. In particular, transaction matrix $T_k$ (corresponding the k-th matrix of the ordered set of transaction matrices, with k=2 . . . n) comprises a number of submatrices corresponding to submatrices of the second matrix greater than a previous transaction matrix $T_{k-1}$ comprises. Moreover, transaction matrix $T_k$ comprises a number of submatrices corresponding to submatrices of the first matrix lower than the previous transaction matrix $T_{k-1}$ comprises.

Then, using a mathematical syntax, the transaction matrices comprise submatrices so that:

$$\#S2_k > \#S2_{k-1} \text{ and } \#S1_k < \#S1_{k-1},\ k=2 \ldots n$$

where:

$\#S2_k$ indicates the number of submatrices of the transaction matrix $T_k$ that correspond to submatrices of the second matrix, $\#S2_{k-1}$ indicates the number of submatrices of the transaction matrix $T_{k-1}$ that correspond to submatrices of the second matrix, $\#S1_k$ indicates the number of submatrices of the transaction matrix $T_k$ that correspond to submatrices of the first matrix, $\#S1_{k-1}$ indicates the number of submatrices of the transaction matrix $T_{k-1}$ that correspond to submatrices of the first matrix, index k is any integer value between 2 and n, where n is the number of the transaction matrices.

As a result, the transaction matrix $T_1$ is the most similar to the first matrix, whereas the transaction matrix $T_n$ is the most similar to the second matrix.

In a preferred embodiment, all submatrices have the same sizes and in particular a size (row or column) is equal to N.

The switch between different filters (i.e. the different matrices) can be done by a standard "crossfade" (i.e. a decrease in the level of an audio signal corresponding to a filter while the audio signal corresponding to another filter increases) between the audio coming from a filter in use and that coming from a following filter: the signal of the filter in use and the one of the following filter are then mixed so as to progressively fade the volume of the former to zero and progressively increase the volume of the latter to the maximum value, thus giving the user a sensation of great smoothness.

Figure 6:
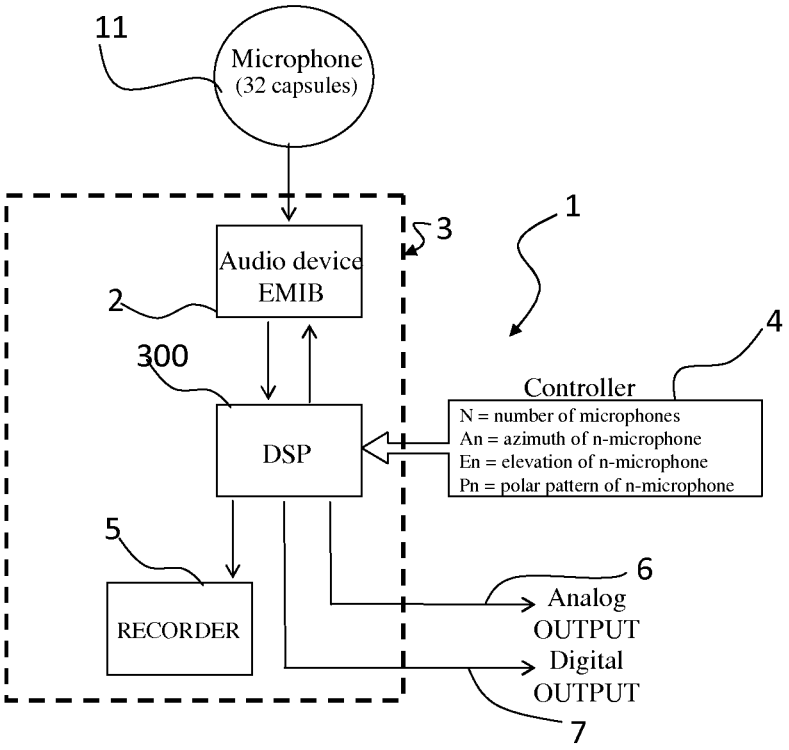
FIG. 6 illustrates an audio acquisition system 1 according to the present invention for implementing the method according to the present invention.

Referring now to FIG. 6, there is shown an audio acquisition system 1 for implementing the above-described method.

The system 1 allows to pick up audio signals coming from an environment.

The system 1 comprises a microphone probe 11 comprising a plurality of capsules (e.g. a 32-channel microphone probe called "em32 Eigenmike", sold by company mhAcoustics), whose signals are pre-amplified and converted into digital form.

The probe 11 is connected to an electronic computer 3 equipped with an audio interface 2 (e.g. an EMIB firewire audio interface), which receives the signals from the probe and transmits them, after having possibly processed them, to a processor 300, e.g. a DSP (Digital Signal Processor), programmed for executing the above-described audio acquisition method.

The system 1 further comprises a data or command input unit 4, also connected to the computer 3, e.g. through a USB (Universal Serial Bus) port, by means of which an operator can supply information about the area where sound must be acquired or directly enter the parameters of one or more virtual microphones (e.g. by selecting predefined forms of directivity by means of buttons).

The data or command input unit 4 may be, for example, a control console equipped with a joystick for controlling the pointing of the virtual microphones.

The system 1 further comprises a recorder 5 and/or an analog output 6 and/or a digital output 7 through which it can record or transmit the signal picked up by the virtual microphone(s).

In the example of FIG. 6, the recorder 5, the analog output 6 and the digital output 7 are all installed inside the computer 3; alternatively, the recorder 5 may be external to the computer 3 and connected thereto.

Figure 7:
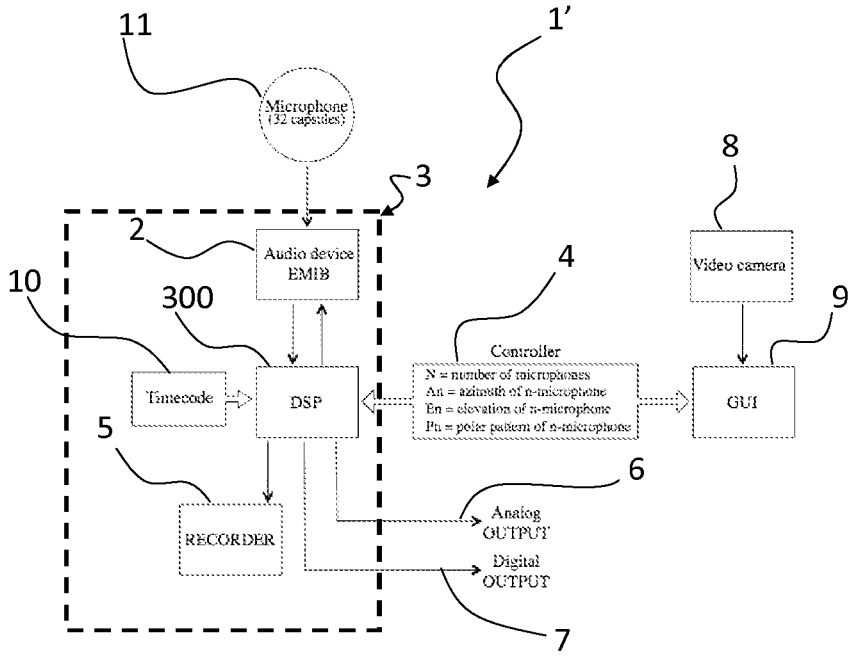
FIG. 7 shows a first variant of the audio acquisition system according to the present invention.

FIG. 7 shows an enhanced version of the system 1, designated 1'; this enhanced system allows audio signals to be acquired from an environment and synchronized with video images of that same environment.

In addition to the parts designated by the same reference numerals in FIG. 6 and having the same functions, the system 1' also comprises a video camera 8 that films the environment whose audio signals are to be detected by the probe 11, graphic interface means 9, and a timer 10 (preferably internal to the computer 3 and connected to the processor 300) for synchronizing the audio picked up by the probe 11 with the video captured by the video camera 8.

The video camera 8 frames the environment where the scene whose audio is to be acquired is taking place; for this purpose, the video camera 8 is a wide angle video camera, e.g. of the "dome" type typically used for surveillance purposes or the like.

The video camera 8 transmits the acquired video signal to the graphic interface means 9, which comprise a monitor for displaying the images taken by the video camera 8.

The same graphic interface means 9 are operationally connected to the data or command input unit 4, and therefore receive information about the virtual microphone(s) selected by the operator.

The graphic interface means 9 process this information and translate it graphically; in particular, they display, superimposed on the images taken by the video camera 8, a mobile pointer which indicates the area being listened to by the virtual microphone chosen by the operator.

Preferably, the shape and size of the pointer are related to the microphone's directivity and orientation, so as to reflect the parameters of the microphone in use and allow it to be controlled more intuitively by the operator.

The data or command input unit 4 may advantageously be fitted with a control lever or a slider or the like to allow an operator to zoom in or out the sound field of the virtual microphone in a quick and intuitive manner.

Through the data or command input unit 4, the operator thus moves the microphone within the filmed scene and can listen separately to different sound sources included in the taken image.

By moving the joystick, the operator moves the virtual microphone and can follow the movement thereof thanks to the images displayed by the graphic interface means 9. By acting upon the slider the operator can control directivity, and the pointer's size changes accordingly.

In a further alternative embodiment, the pointer may be replaced with coloured areas corresponding to the regions being listened to by the microphone; for example, the best received area may be displayed in red, the other areas being displayed with colder colours according to their reception quality. When the virtual microphone is moved or its directivity is changed, the colour of the images will change as well.

Figure 8:
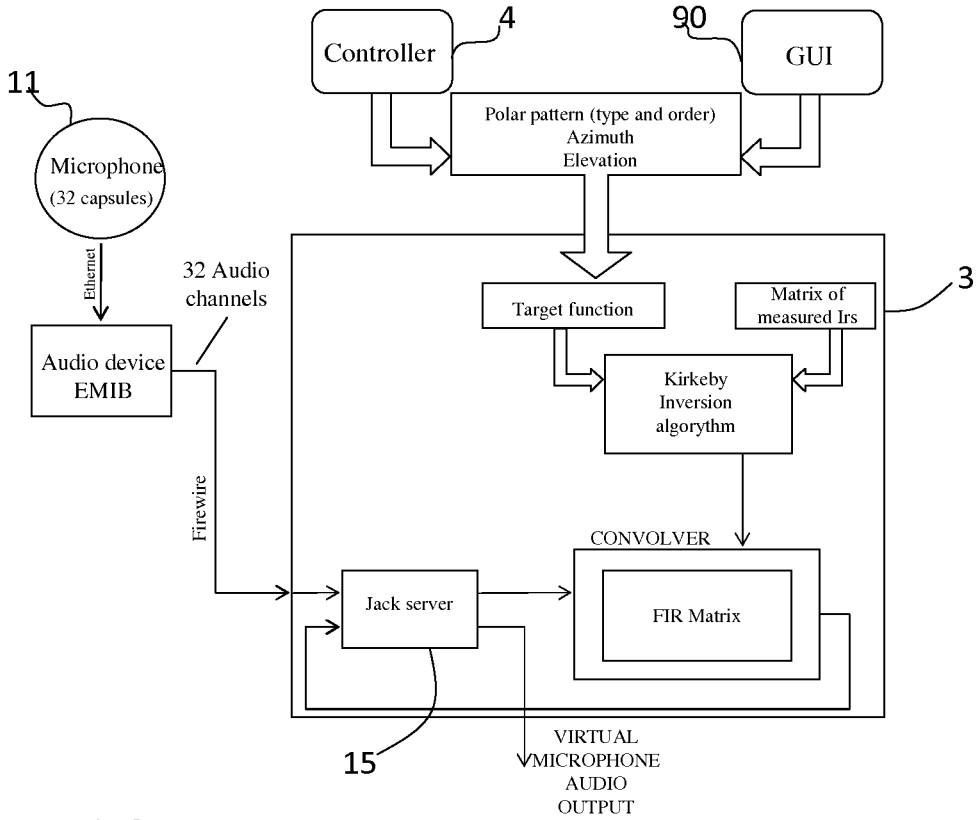
FIG. 8 shows a second variant of the audio acquisition system according to the present invention.

FIG. 8 shows a variant of the system of FIG. 7.

In this example, the operator has the possibility of setting the parameters of the virtual microphone through the data or command input unit 4 or the graphic interface 90, thereby pointing the virtual microphone (in terms of azimuth and elevation) and selecting its directivity (cardioid, supercardioid, cardioid of the 3rd order, etc.).

The graphic interface means 90 of FIG. 8 comprise for this purpose a touch screen which displays the images coming from the video camera 8 and the microphone pointer, as previously explained with reference to FIG. 7.

By interacting with the touch screen, the operator can move the microphone or change the extent of the space to be listened to, i.e. change the microphone's orientation and directivity.

The virtual microphone data thus set by the user is sent to the processor 300, where the execution of some code portions allows for the generation of the above-mentioned target function A and the calculation of the Kirkeby algorithm, which is made by using the IRs matrix of impulse responses (measured in the aforementioned PROBE CHARACTERIZATION step) pre-loaded into the memory and relating to the microphone probe 11.

The filter matrix H is then generated as previously described.

The file containing the FIRs filter coefficients is then used in order to carry out the filtering process with the audio data coming from the microphone probe 11.

The virtual microphone signal synthesized by said filtering process is returned to a Jack interface 15, which may then deliver it to digital outputs (ADAT) provided on the EMIB card or divert it towards a memory card.

Every time the virtual microphone's parameters are changed (e.g. when directivity is changed), the Kirkeby algorithm is executed again and a new matrix H is calculated, so that a change is made in real time.

In this respect, the processor 3 or the processor 300 preferably comprises a memory area (e.g. a flash memory) which stores the matrix $$\Gamma = \frac{Conj[IRs(\omega)]}{Conj[IRs(\omega)] \cdot IRs(\omega) + \varepsilon(\omega)}$$

calculated during the probe characterization step and therefore dependent on the capsules' impulse responses calculated by using the predetermined and known test signals.

This solution allows to reduce the computational cost required by the above-described audio acquisition method; when the matrix H is to be re-calculated, it is not necessary to recalculate Γ, but only the product of the matrices A and Γ.

Although the present invention has been described herein with reference to some preferred embodiments, it is apparent that those skilled in the art may make several changes to the above-described audio acquisition system and audio acquisition method.

In particular, the various elements and logic blocks of the audio acquisition system may be composed and distributed in many different ways while still carrying out, as a whole, the same functions or functions being equivalent to those described herein.

The invention claimed is:

1. Method for acquiring audio signals, wherein a microphone probe equipped with a plurality of microphone capsules detects a plurality of audio signals and wherein said detected audio signals are combined in order to obtain a signal of a virtual microphone, wherein said signal of the virtual microphone is generated as a function of characteristic probe data measured during a probe characterization step, wherein the signals detected by each microphone capsule are measured following a corresponding predetermined test signal, wherein said signal of a virtual microphone is calculated on the basis of desired virtual microphone parameters of the virtual microphone, and wherein said signal of a virtual microphone is generated by filtering the signals received by said plurality of capsules through a filter H calculated according to the following formula:

$$H = A \cdot \frac{Conj[IRs(\omega)]}{Conj[IRs(\omega)] \cdot IRs(\omega) + \varepsilon(\omega)}$$

where:

IRs(ω) is the matrix of the impulse responses of each microphone capsule in response to said predetermined test signal, A is a so-called "target function" matrix generated on the basis of said virtual microphone parameters, ϵ(ω) is a predefined adjustment parameter.

2. Method according to claim 1, wherein the probe characterization step comprises:

subjecting said probe to multiple test signals whose emission coordinates M, K relative to the probe are known, detecting the signals picked up by each microphone capsule of said probe at said test signals, generating a matrix of the impulse responses of said capsules.

3. Method according to claim 1, wherein every change in the virtual microphone parameters of said virtual microphone is followed by a new generation of filters which can be used for filtering the signals received by said plurality of capsules and generating a new audio signal of said virtual microphone.

4. Method according to claim 3, wherein the following occurs when the virtual microphone parameters of said virtual microphone are changed in order to switch from a first virtual microphone, corresponding to a first filter, to a second virtual microphone:

a second filter corresponding to the second virtual microphone is calculated;

an ordered set of transaction filters is calculated, wherein each of said transaction filters comprises submatrices corresponding to submatrices of either said first filter or said second filter, wherein the number of second filter submatrices of said transaction filter is greater than the number of second filter submatrices of a previous transaction filter, and wherein the number of first filter submatrices of said transaction filter is lower than the number of first filter submatrices of a previous transaction filter;

the signal picked up by said capsules is filtered through said transaction filters according to the order of said set of transaction filters;

after the last transaction filter of said set, the signal picked up by said capsules is filtered through said second filter.

5. Method according to claim 4, wherein the following occurs in order to switch from a filter in use to a filter following said filter in use:

said filter following said filter in use is calculated;

the signal picked up by said capsules (B) is filtered through said filter following said filter in use;

signals of said filter in use and of said filter following said filter in use are mixed together;

the level of the signal of said filter in use is decreased proportionally to the increase in the level of the signal of said filter following said filter in use.

6. Method according to claim 1, wherein a video camera takes images of an area where audio signals are to be acquired by means of said virtual microphone, wherein said taken images are displayed on a monitor and wherein at least one graphic element, the shape and/or size of which depend on characteristics of said virtual microphone, is superimposed on said displayed images.

7. Method according to claim 1, wherein an operator sets orientation and/or directivity characteristics of said virtual microphone.

8. Method according to claim 1, wherein said virtual microphone parameters comprise orientation and directivity of the virtual microphone.

9. Audio acquisition system, comprising at least one microphone probe equipped with a plurality of microphone capsules for detecting a plurality of audio signals, and at least one processor adapted to combine the signals received by said plurality of capsules in order to obtain a signal of a virtual microphone, wherein it comprises a memory area storing characteristic data of said capsules measured following a predetermined test signal, and that said processor comprises code portions which, when executed, allow said signal of a virtual microphone to be generated on the basis of said characteristic data of the capsules and to be calculated on the basis of desired virtual microphone parameters of the virtual microphone, and wherein said processor comprises code portions which, when executed, allow said signal of a virtual microphone to be generated by filtering the signals received by said plurality of capsules through a filter H calculated according to the following formula:

$$H = A \cdot \frac{Conj[IRs(\omega)]}{Conj[IRs(\omega)] \cdot IRs(\omega) + \varepsilon(\omega)}$$

where:

IRs(ω) is the matrix of the impulse responses of each microphone capsule in response to said predetermined test signal, A is a so-called "target function" matrix generated on the basis of said virtual microphone parameters, ϵ(ω) is a predefined adjustment parameter.

10. System according to claim 9, further comprising means feasible to an operator of said system for setting the virtual microphone parameters of at least one virtual microphone.

11. System according to claim 10, wherein said means feasible to an operator comprise a touch screen.

12. System according to claim 9, further comprising a recorder and/or an analog output and/or a digital output for recording and/or transmitting the signal picked up by the at least one virtual microphone.

13. System according to claim 9, wherein said system comprises a video camera operationally connected to graphic interface means adapted to display on a monitor the images taken by said video camera, and wherein said processor is adapted to transmit information about characteristics of said virtual microphone to said graphic interface means, so that said graphic interface means can generate a graphic element adapted to be superimposed on said images displayed on said monitor and representative of said virtual microphone.

14. System according to claim 9, wherein said system comprises a video camera operationally connected to graphic interface means adapted to display on a monitor the images taken by said video camera, and wherein said system comprises a timer for synchronizing the audio picked up by the probe with the video picked up by the video camera.

15. System according to claim 9, wherein said virtual microphone parameters comprise orientation and directivity of the virtual microphone.

* * * * *